US005581224A

United States Patent [19]

Yamaguchi

[11] Patent Number: 5,581,224

[45] Date of Patent: Dec. 3, 1996

[54] CHOKE COIL FOR ELIMINATING COMMON MODE NOISE AND DIFFERENTIAL MODE NOISE

[75] Inventor: Kouichi Yamaguchi, Kukui-Ken, Japan

[73] Assignee: Murata Manufacturing Co., Ltd., Japan

[21] Appl. No.: 543,164

[22] Filed: Oct. 13, 1995

[30] Foreign Application Priority Data

Oct. 14, 1994 [JP] Japan ..... 6-249528

[51] Int. Cl.[6] ..... H01F 27/26; H01F 27/30

[52] U.S. Cl. ..... 336/212; 336/181; 336/215; 336/233

[58] Field of Search ..... 336/83, 212, 215, 336/214, 229, 160, 221, 181, 233

[56] References Cited

U.S. PATENT DOCUMENTS 4,205,288 5/1980 Lin et al. ..... 336/212

4,910,482 3/1990 Takagai et al. ..... 336/212

5,083,101 1/1992 Frederick ..... 336/229

*Primary Examiner*—Thomas J. Kozma

*Attorney, Agent, or Firm*—Ostrolenk, Faber, Gerb & Soffen, LLP

[57] ABSTRACT

A choke coil which functions not only to eliminate common mode noise but also to eliminate differential mode noise. A couple of coils are wound around a circular first core and a second core which is disposed inside the circular first core. The second core has a circular frame and a bridge which is laid in the frame. The first core may be easy to become magnetic saturation but is made of a material with a large magnetic permeability, and preferably a material with a relative magnetic permeability of several thousand, such as ferrite and amorphous. The second core is made of a material which is hard to become magnetic saturation, and preferably a material with a relative magnetic permeability of some scores to several hundred, such as dust core.

7 Claims, 3 Drawing Sheets

CHOKE COIL FOR ELIMINATING COMMON MODE NOISE AND DIFFERENTIAL MODE NOISE

BACKGROUND OF THE INVENTION

1. Field of the Invention

The present invention relates to a choke coil, and more particularly to a choke coil which eliminates noise leaking out of an electronic appliance.

2. Description of Related Art

A conventional common mode choke coil has a structure wherein a couple of coils are wound around a circular core. In eliminating strong differential mode noise by use of this type of common mode choke coil, a large-sized choke coil is required, and the choke coil occupies a large area of a printed circuit board.

A choke coil disclosed by Japanese Patent Laid Open Publication No. 4-91412 is very effective to eliminate differential mode noise and common mode noise. However, this choke coil has a structure wherein three circular cores are linked, and this is unsatisfactory with respect to size and cost.

SUMMARY OF THE INVENTION

An object of the present invention is to provide a choke coil which is sufficiently effective to eliminate not only common mode noise but also differential mode noise without increasing the size.

In order to attain the object, a choke coil according to the present invention comprises: a circular first core; a second core which is disposed inside the circular first core, the second core having a circular frame and a bridge laid in the frame; and a couple Of coils which are wound around the first core and the second core.

In the structure, the first core and the couple of coils function as a common mode choke coil, while the second core and the couple of coils function as a differential mode choke coil.

BRIEF DESCRIPTION OF THE DRAWINGS

This and other objects and features of the present invention will be apparent from the following description with reference to the accompanying drawings, in which.

DETAILED DESCRIPTION OF THE PREFERRED EMBODIMENTS

Some embodiments of the present invention are described with reference to the accompanying drawings.

First Embodiment: FIGS. 1–4

Figure 1:
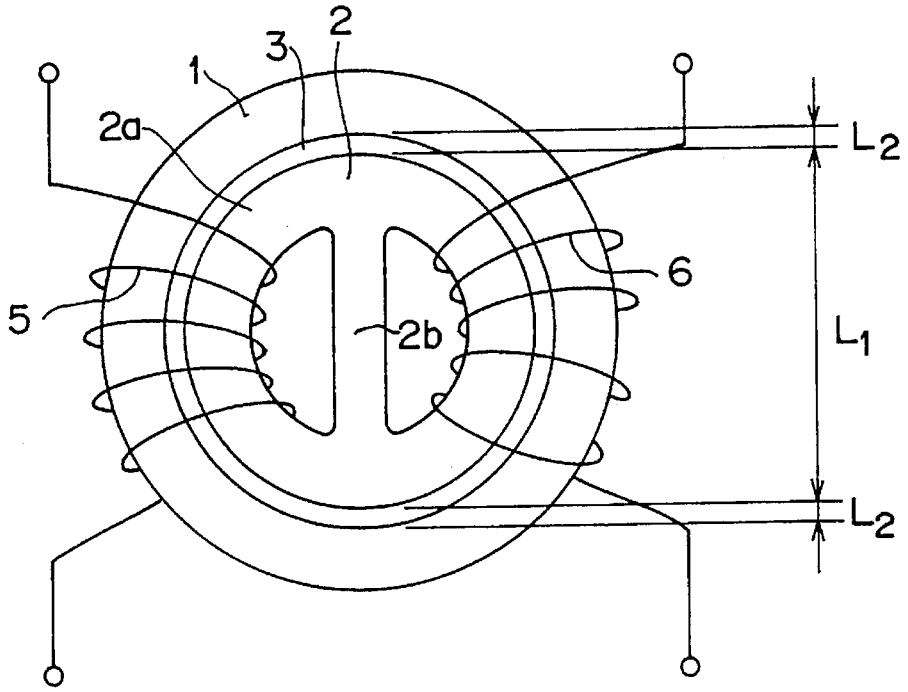
FIG. 1 is a plan view of a choke coil which is a first embodiment of the present invention.

As shown in FIG. 1, a choke coil of the first embodiment comprises a circular first core 1, a second core 2 which is disposed inside the circle of the first core 1, a spacer 3 which is disposed between the first core 1 and the second core 2, and a couple of coils 5 and 6 which are wound around the first and second cores 1 and 2. The first core 1 is annular and has a rectangular cross section. The first core 1 is made of a material which may be easy to become magnetic saturation but has a large magnetic permeability, and preferably, has a relative magnetic permeability $\mu_1$ of several thousand. More specifically, ferrite, amorphous or the like is used as the material of the first core 1.

The second core 2 has a circular frame 2*a* and a bridge 2*b* which is laid in the circular frame 2*a*. The second core 2 has a rectangular cross section. The second core 2 is made of a material which is hard to become magnetic saturation, and preferably, has a relative magnetic permeability $\mu_2$ of some scores to several hundred. More specifically, dust core or the like is used as the material of the second core 2.

The spacer 3 is annular and has a rectangular cross section. The spacer 3 makes a space $L_2$ larger than a specified value between the first core 1 and the second core 2. Thereby, a magnetic flux induced by a flow of a regular signal current or a power current in the coils 5 and 6 is prevented from leaking from the first core 1 to the second core 2, and magnetic saturation of the first core 1 is prevented. If the first core 1 comes to magnetic saturation, the first core 1 will lose the function of eliminating common mode noise. As long as anything which can make the space $L_2$ between the first core 1 and the second core 2 is provided, the spacer 3 is not indispensable. The space $L_2$ preferably fulfills the following condition:

$$L_2>(L_1/2\mu_2) \quad (1)$$

$$(\mu_1>\mu_2)$$

$L_1$: diameter of the circular frame 2*a* of the second core 2

Referring to specific values, if $\mu_2$=20 and $L_1$=10 mm, $L_2$>0.25 mm in order to meet the condition (1). The coils 5 and 6 are wound around the first and second cores 1 and 2 separated by the bridge 2*b* of the second core 2.

Now, the action of the choke coil is described.

The first core 1 and the coils 5 and 6 function as a common mode choke coil. The second core 2 and the coil 5, and the second core 2 and the coil 6 function as differential mode choke coils.

Figure 2:
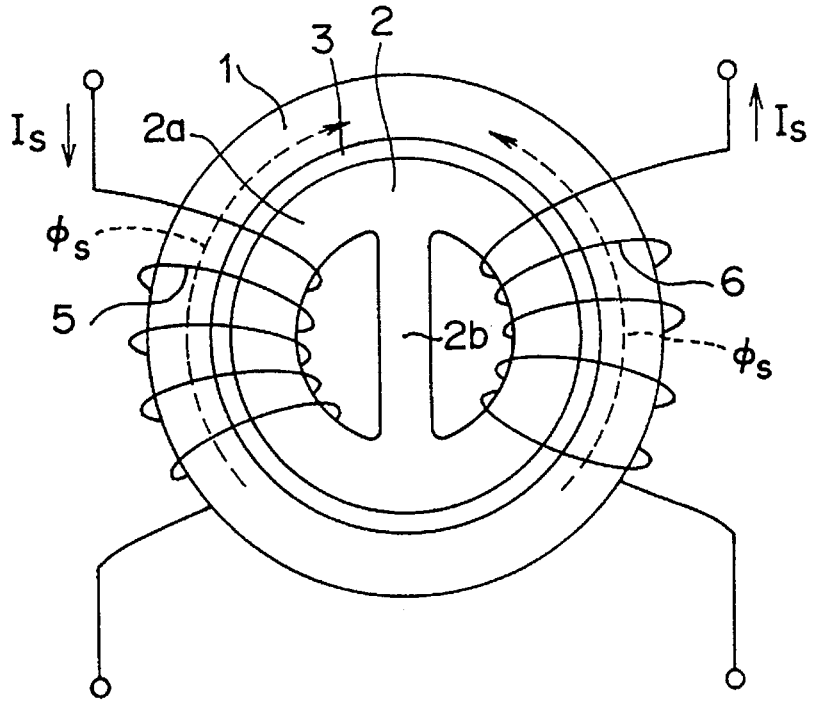
FIG. 2 is a magnetic circuit diagram of the choke coil when a regular signal is transmitted in the choke coil.

As shown in FIG. 2, when a regular signal or a power current $I_s$ flows in the coils 5 and 6 as indicated by the arrows, two magnetic fluxes $\phi_s$ of the same strength and mutually opposite directions occur in the first core 1. The magnetic fluxes $\phi_s$ counteract each other, and the choke coil has no reactance.

Figure 3:
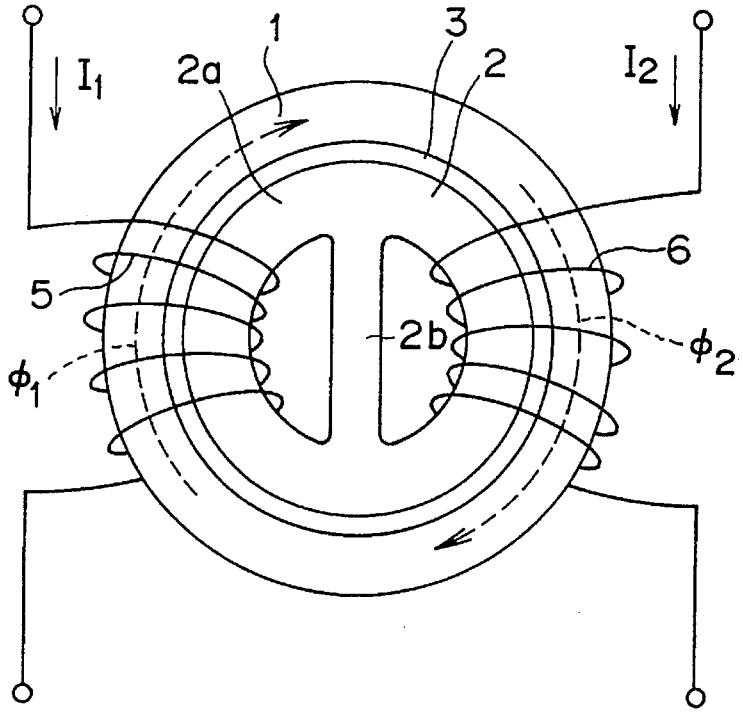
FIG. 3 is a magnetic circuit diagram of the choke coil showing the function of eliminating common mode noise.

Referring to FIG. 3, the common mode noise eliminating function of the choke coil is described. When common mode noise currents $I_1$ and $I_2$ flow in the coils 5 and 6, respectively, as indicated by the arrows in FIG. 3, magnetic fluxes $\phi_1$ and $\phi_2$ occur in the first core 1. The magnetic fluxes $\phi_1$ and $\phi_2$ come together and decline gradually while circulating in a closed magnetic circuit of the first core 1. This is because the magnetic fluxes $\phi_1$ and $\phi_2$ are converted into heat energy as an eddy current loss or the like. Thereby, the common mode noise currents $I_1$ and $I_2$ are weakened.

Figure 4:
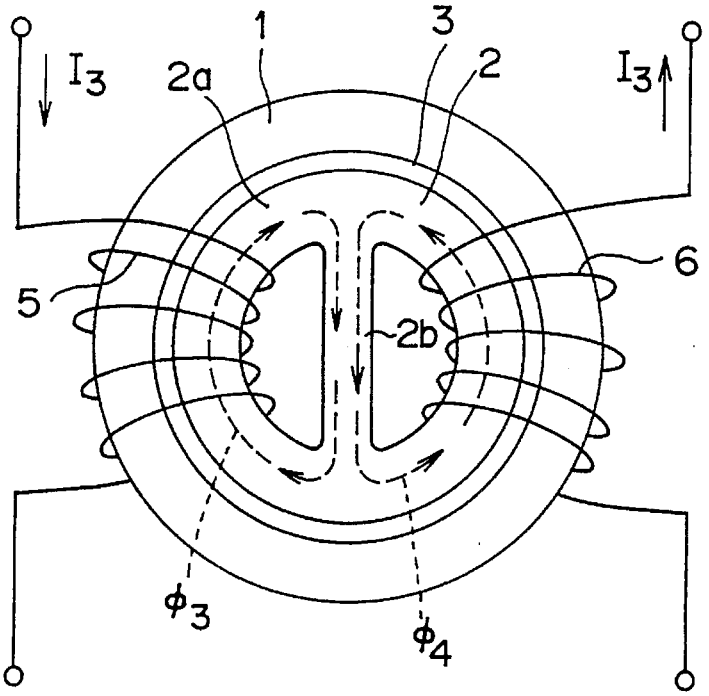
FIG. 4 is a magnetic circuit diagram of the choke coil showing the function of eliminating differential mode noise.

Referring to FIG. 4, the differential mode noise eliminating function of the choke coil is described. A differential mode noise current $I_3$ flows in the coils 5 and 6 as indicated by the arrows in FIG. 4, magnetic fluxes $\phi_3$ and $\phi_4$ occur in the second core 2. The magnetic flux $\phi_3$ circulates in a closed magnetic circuit formed of the left half of the ring frame 2*a* and the bridge 2*b*, and the magnetic flux $\phi_4$ circulates in a closed magnetic circuit formed of the right half of the ring frame 2*a* and the bridge 2*b*. The magnetic fluxes $\phi_3$ and $\phi_4$ are converted into heat energy as eddy current losses or the like and decline gradually while circulating in the respective closed magnetic circuits. Thereby, the differential mode noise current $I_3$ is weakened.

The size of this choke coil is substantially the same as the size of the first core 1. The choke coil has a smaller number of cores than a conventional choke coil, and accordingly, the cost can be reduced.

Figure 5:
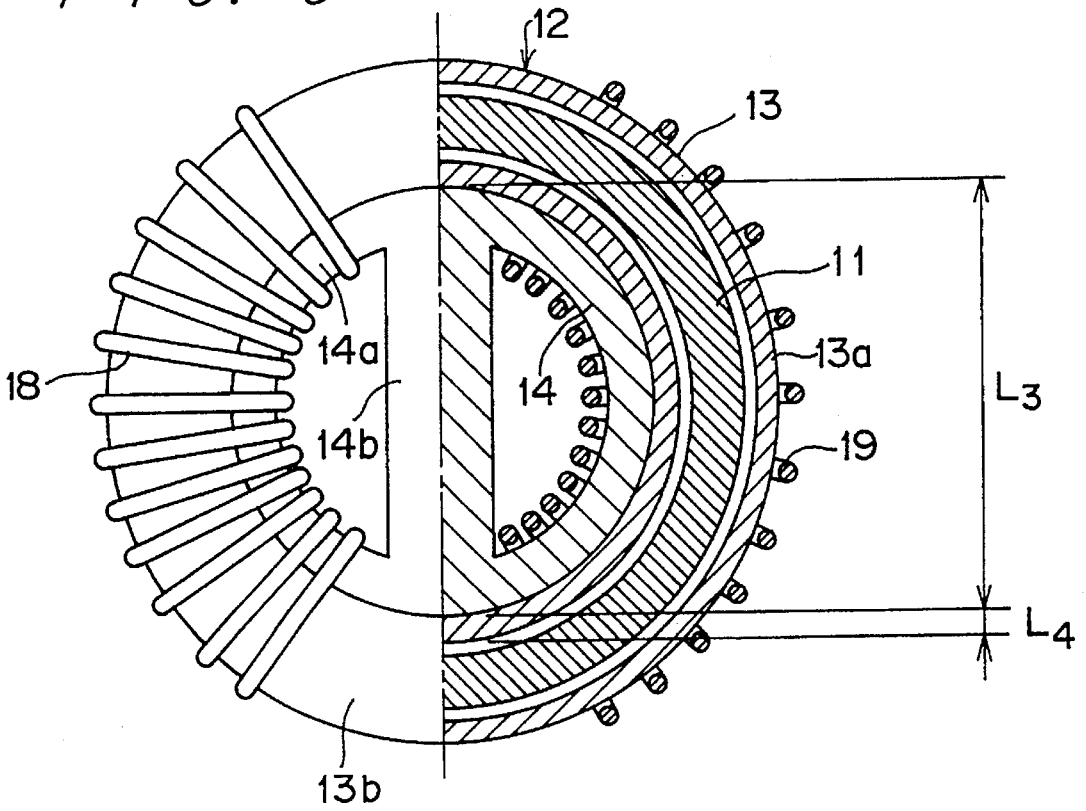
FIG. 5 is a partly horizontal sectional view of a choke coil which is a second embodiment of the present invention.
Figure 6:
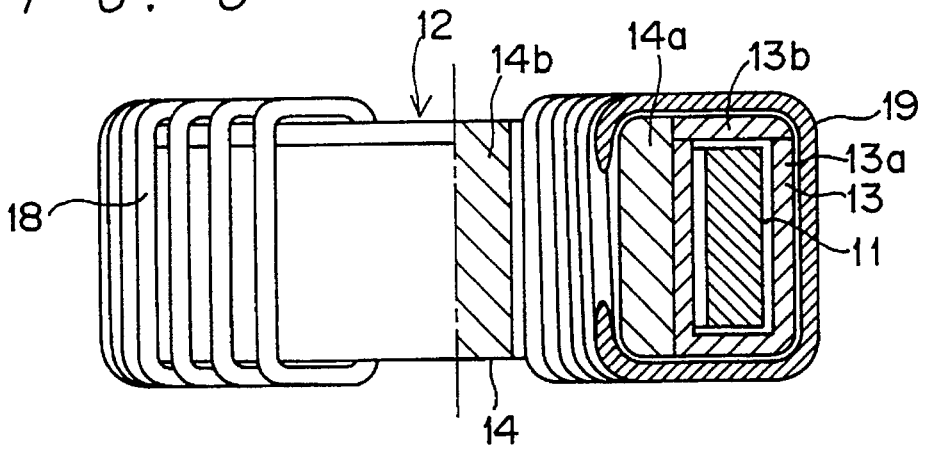
FIG. 6 is a partly longitudinal sectional view of the choke coil of FIG. 5.

Second Embodiment: FIGS. 5 and 6

FIGS. 5 and 6 show a choke coil which is a second embodiment of the present invention. The choke coil of the second embodiment comprises a core 11 which serves as a first core, a case 12 which contains the core 11 and partly serves as a second core, and a couple of coils 18 and 19. The core 11 is annular and has a rectangular cross section. The core 11 may be made of a material which comes to magnetic saturation easily but has a large magnetic permeability, and preferably, has a relative magnetic permeability $\mu_1$ of several thousand. More specifically, ferrite, amorphous or the like is used as the material of the core 11.

The case 12 has a hollow circular non-magnetic portion 13 and a magnetic portion 14 which is inside the circle of the non-magnetic portion 13. The non-magnetic portion 13 is made of resin such as polyphenylene sulfide resin, and is formed of a container 13*a* and a lid 13*b*. After the core 11 is placed in the container 13*a*, the lid 13*b* is fixed onto the container 13*b*. The magnetic portion 14 is made of resin containing Ni—Zn ferrite powder. The magnetic portion 14 has a relative magnetic permeability $\mu_2$ of some scores. The magnetic portion 14 has a circular frame 14*a* and a bridge 14*b* laid in the circular frame 14*a*. The magnetic portion 14 serves as a second core.

Preferably, the thickness $L_4$ of the side wall of the container 13*a* which is in contact with the magnetic portion 14 fulfills the following condition:

$$L_4>(L_3/2\mu_2)$$

$$(\mu_1>\mu_2)$$

$L_3$: diameter of the circular frame 14*a* of the magnetic portion 14

The coils 18 and 19 are wound around the case 12 separated by the bridge 14*b*.

The choke coil of the second embodiment acts in the same way as the first embodiment. In the second embodiment, the case 12 partly functions as a second core. Therefore, the number of parts can be decreased, and a smaller choke coil can be obtained.

Other Embodiments

The first core and the second core are not have to be circular and may be rectangular.

Although the present invention has been described in connection with the preferred embodiments above, it is to be noted that various changes and modifications are possible to those who are skilled in the art. Such changes and modifications are to be understood as being within the present invention.

What is claimed is:

1. A choke coil for eliminating common mode noise and differential mode noise, the choke coil comprising:

a circular first core;

a second core which is disposed inside the circular first core, the second core having a circular frame and a bridge laid in the frame; and a couple of coils which are wound around the first core and the second core.

2. A choke coil as claimed in claim 1, wherein the first core has a larger relative magnetic permeability than the second core.

3. A choke coil as claimed in claim 1, wherein the couple of coils are wound around the first core and the second core separated by the bridge of the second core.

4. A choke coil as claimed in claim 1, further comprising:

a spacer which is disposed between the first core and the second core to prevent magnetic saturation of the first core.

5. A choke coil for eliminating common mode noise and differential mode noise, the choke coil comprising:

a circular core;

a case for encasing the core, the case comprising:

a hollow circular non-magnetic portion which has a container in which the case is placed and a lid;

a magnetic portion which is disposed inside the circular non-magnetic portion, the magnetic portion having a circular frame and a bridge laid in the frame; and a couple of coils which are wound around the case.

6. A choke coil as claimed in claim 5, wherein the core has a larger relative magnetic permeability than the magnetic portion of the case.

7. A choke coil as claimed in claim 5, wherein the couple of coils are wound around the case separated by the bridge of the magnetic portion.

* * * * *